US007509698B2

(12) United States Patent
Poulos

(10) Patent No.: US 7,509,698 B2
(45) **Date of Patent: *Mar. 31, 2009**

(54) THERAPEUTIC MATTRESS

(75) Inventor: Craig Poulos, Wilmette, IL (US)

(73) Assignee: Kreg Medical, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/650,737

(22) Filed: Jan. 8, 2007

(65) Prior Publication Data

US 2007/0113352 A1 May 24, 2007

Related U.S. Application Data

(63) Continuation of application No. 11/349,683, filed on Feb. 8, 2006.

(60) Provisional application No. 60/707,074, filed on Aug. 10, 2005.

(51) Int. Cl.
*A47C 27/10* (2006.01)
*A47C 27/18* (2006.01)

(52) U.S. Cl. ..... 5/710; 5/706; 5/727

(58) Field of Classification Search ..... 5/706, 5/707, 710, 727, 737, 654, 739, 738
See application file for complete search history.

(56) References Cited

U.S. PATENT DOCUMENTS 3,394,415 A 7/1968 Parker
3,605,145 A 9/1971 Graebe
3,701,173 A 10/1972 Whitney
3,872,525 A * 3/1975 Lea et al. ..... 5/671
4,042,988 A * 8/1977 Holliday ..... 5/710
4,224,706 A * 9/1980 Young et al. ..... 5/710
4,391,009 A 7/1983 Schild et al.
4,449,261 A * 5/1984 Magnusson ..... 5/722

(Continued)

FOREIGN PATENT DOCUMENTS

DE 8610640 U1 6/1986

(Continued)

OTHER PUBLICATIONS

U.S. Appl. No. 11/349,683, filed Feb. 8, 2006, Poulos.

(Continued)

*Primary Examiner*—Alexander Grosz
(74) *Attorney, Agent, or Firm*—McDermott Will & Emery LLP

(57) ABSTRACT

A therapeutic mattress is providing including an encasing housing a base layer and a patient support layer in a cavity of the encasing. The base layer has a foam base member and foam side panels connected to the base member. The patient support layer is provided above the base layer and has a plurality of sections or zones. In one embodiment the plurality of sections is made of an inflatable component, and another of the plurality of sections is made of a non-inflatable component. In an alternate embodiment, each of the sections contains an inflatable component. In one embodiment, the zones of the patient support surface include a head zone adjacent a head of the mattress, a foot zone adjacent a foot end of the mattress, a seat zone adjacent the head zone, and a knee zone between the seat zone and the foot zone.

5 Claims, 6 Drawing Sheets

U.S. PATENT DOCUMENTS 4,686,725 A 8/1987 Mitchell
4,706,313 A 11/1987 Murphy
4,897,890 A 2/1990 Walker
4,901,387 A 2/1990 Luke
4,947,500 A * 8/1990 Seiler ..... 5/713
4,949,414 A 8/1990 Thomas et al.
4,977,629 A 12/1990 Jones
4,986,738 A 1/1991 Kawasaki et al.
5,025,519 A 6/1991 Spann et al.
5,031,261 A 7/1991 Fenner, Sr.
5,039,158 A 8/1991 Maier
5,070,560 A 12/1991 Wilkinson
5,107,558 A 4/1992 Lück
5,109,560 A 5/1992 Uetake
5,117,521 A 6/1992 Foster et al.
5,121,513 A 6/1992 Thomas et al.
5,129,115 A 7/1992 Higgins et al.
5,163,196 A 11/1992 Graebe et al.
5,179,742 A 1/1993 Oberle
5,182,826 A 2/1993 Thomas et al.
5,233,974 A 8/1993 Senoue et al.
5,243,721 A 9/1993 Teasdale
5,249,319 A 10/1993 Higgs
5,252,278 A 10/1993 Spann et al.
5,259,079 A * 11/1993 Visser et al. ..... 5/685
5,325,551 A 7/1994 Tappel et al.
5,335,651 A 8/1994 Foster et al.
5,337,845 A 8/1994 Foster et al.
5,370,111 A 12/1994 Reeder et al.
D355,322 S 2/1995 Ackley et al.
5,398,354 A 3/1995 Balonick et al.
5,412,821 A 5/1995 Wilkinson
5,425,148 A 6/1995 Ashcraft et al.
5,454,142 A 10/1995 Neely et al.
5,457,831 A 10/1995 Foster et al.
5,461,741 A 10/1995 Graebe
5,479,666 A 1/1996 Foster et al.
5,483,709 A 1/1996 Foster et al.
5,497,766 A 3/1996 Foster et al.
5,513,406 A 5/1996 Foster et al.
5,551,107 A * 9/1996 Graebe ..... 5/654
5,562,091 A 10/1996 Foster et al.
5,568,660 A * 10/1996 Raburn et al. ..... 5/652.1
5,577,279 A 11/1996 Foster et al.
5,580,504 A 12/1996 Spann et al.
5,586,346 A 12/1996 Stacy et al.
5,596,781 A 1/1997 Graebe
5,606,754 A 3/1997 Hand et al.
5,611,096 A 3/1997 Bartlett et al.
5,613,255 A 3/1997 Bish et al.
5,630,238 A 5/1997 Weismiller et al.
5,634,224 A 6/1997 Gates
5,642,546 A 7/1997 Shoenhair
5,649,331 A 7/1997 Wilkinson et al.
5,652,985 A 8/1997 Wilkinson et al.
5,666,681 A 9/1997 Meyer et al.
5,672,849 A 9/1997 Foster et al.
5,680,661 A 10/1997 Foster et al.
5,689,845 A 11/1997 Sobieralski
5,708,997 A 1/1998 Foster et al.
5,715,548 A 2/1998 Weismiller et al.
5,731,062 A 3/1998 Kim et al.
5,745,937 A 5/1998 Weismiller et al.
5,781,949 A 7/1998 Weismiller et al.
5,845,352 A 12/1998 Matsler et al.
5,933,888 A 8/1999 Foster et al.
5,963,998 A 10/1999 Carew et al.
5,983,429 A 11/1999 Stacy et al.
5,987,668 A 11/1999 Ackley
6,036,271 A 3/2000 Wilkinson et al.
6,047,424 A 4/2000 Osborne et al.
6,098,222 A 8/2000 Hand et al.
6,112,345 A 9/2000 Foster et al.
6,119,291 A 9/2000 Osborne et al.
6,151,739 A 11/2000 Meyer et al.
6,163,903 A 12/2000 Weismiller et al.
6,212,714 B1 4/2001 Allen et al.
6,223,369 B1 5/2001 Maier et al.
6,256,821 B1 7/2001 Boyd
6,256,822 B1 7/2001 Weston et al.
6,269,504 B1 8/2001 Romano et al.
6,269,505 B1 8/2001 Wilkinson
6,286,166 B1 9/2001 Henley et al.
6,324,709 B1 12/2001 Ikeda et al.
6,351,863 B1 3/2002 Meyer et al.
6,353,950 B1 3/2002 Bartlett et al.
6,374,436 B1 4/2002 Foster et al.
6,415,814 B1 7/2002 Hand et al.
6,446,283 B1 9/2002 Heimbrock et al.
6,481,033 B2 * 11/2002 Fogel ..... 5/727
6,496,993 B2 12/2002 Allen et al.
6,499,167 B1 12/2002 Ellis et al.
6,536,056 B1 3/2003 Vrzalik et al.
6,560,793 B2 5/2003 Walker
6,584,628 B1 7/2003 Kummer et al.
6,601,253 B1 8/2003 Tarquinio
6,611,979 B2 9/2003 Welling et al.
6,623,080 B2 9/2003 Clapper
6,640,361 B2 11/2003 Heimbrock et al.
6,662,393 B2 12/2003 Boyd
6,684,427 B2 2/2004 Allen et al.
6,687,936 B2 2/2004 Graebe et al.
6,694,548 B2 2/2004 Foster et al.
6,701,556 B2 * 3/2004 Romano et al. ..... 5/653
6,725,474 B2 4/2004 Foster et al.
6,745,996 B1 6/2004 Guthrie
6,751,815 B2 6/2004 Heimbrock et al.
6,782,574 B2 8/2004 Totton et al.
6,820,640 B2 11/2004 Hand et al.
6,826,795 B2 12/2004 Wilkinson
6,874,185 B1 4/2005 Phillips et al.
6,880,189 B2 4/2005 Welling et al.
6,892,405 B1 5/2005 Dimitriu et al.
6,901,617 B2 6/2005 Sprouse, II et al.
6,904,631 B2 6/2005 Vrzalik et al.
6,922,863 B2 8/2005 Giori et al.
6,928,681 B1 8/2005 Stacy
6,952,852 B2 10/2005 Reeder et al.
6,976,281 B2 12/2005 Schunk et al.
6,990,700 B2 1/2006 Chung
7,039,972 B2 5/2006 Chaffee
7,114,207 B2 10/2006 Wang
7,120,950 B2 * 10/2006 Garrigues ..... 5/420
7,120,955 B2 10/2006 Wang
7,127,762 B1 10/2006 Lau
7,188,379 B2 * 3/2007 James et al. ..... 5/12.1
7,225,488 B2 6/2007 Wu
7,296,313 B2 11/2007 Hense
7,296,314 B2 11/2007 Wyatt et al.
7,313,837 B2 1/2008 Wang
2002/0059679 A1 5/2002 Weismiller et al.
2003/0079293 A1 5/2003 Ellis et al.
2003/0177584 A1 9/2003 Boyd
2003/0221391 A1 12/2003 Bolton
2004/0034931 A1 2/2004 Kummer et al.
2004/0187217 A1 9/2004 Barman et al.
2005/0012377 A1 1/2005 Ito
2005/0028289 A1 2/2005 Hakamium
2005/0034764 A1 2/2005 Hanh et al.
2005/0166330 A1 8/2005 Williams
2005/0229321 A1 10/2005 Phillips et al.

2006/0031955 A1 2/2006 Barkhouse

FOREIGN PATENT DOCUMENTS

DE 8714843 U1 2/1998
EP 0465810 A1 1/1992
EP 1086681 A1 3/2001
WO WO 98/04170 A 2/1998

OTHER PUBLICATIONS

Stryker, Isoflex Sleep Surface, 2005.
Geltec, Redux Tri-Zone Pressure/Shear Support Surface, at least as early as 2006.

* cited by examiner 58
72
16
62
70
64
60
76
66
58
74
68
60
38
46
28
36
32
18
30
44
34
40
42
14
20

THERAPEUTIC MATTRESS

CROSS-REFERENCE TO RELATED APPLICATIONS

This application is a continuation of U.S. patent application Ser. No. 11/349,683, filed on Feb. 8, 2006, which is a continuation-in-part of U.S. Provisional Patent Application Ser. No. 60/707,074, filed on Aug. 10, 2005, both of which applications are expressly incorporated herein by reference.

FEDERALLY SPONSORED RESEARCH OR DEVELOPMENT

Not Applicable.

TECHNICAL FIELD

The present invention relates generally to a mattress for a hospital bed, and more specifically to a therapeutic mattress having an air composite patient support surface and a rigid perimeter.

BACKGROUND OF THE INVENTION

Mattresses, including therapeutic overlays which assist in preventing bed sores, for hospital beds are well known in the art. While such mattresses and overlays according to the prior art provide a number of advantageous features, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a therapeutic mattress having a base layer, a patient support layer above the base layer, and an encasing over the base layer and the patient support layer. This therapeutic mattress is provided to assist in preventing bed sores and decreasing existing bedsores on patients.

According to one embodiment, the base layer comprises a base member, a foam end member and a plurality of foam side panels connected to the base member. The base member may be comprised of foam, gel, fluid or some other pressure compensating media. Further, the base member may be comprised of one or more inflatable and/or non-inflatable components. Generally, the side panels extend from a head end of the base member to a foot end of the base member of the mattress to create a cavity or well to support the patient support layer.

According to another embodiment, the patient support layer is provided in the well of the base layer. The patient support layer has a plurality of sections or zones. In a preferred embodiment one of the plurality of sections is made of an inflatable component, and another of the plurality of sections is made of a non-inflatable component. The non-inflatable component may also comprise a plurality of individual air cells fluidly interconnected. In one embodiment, the patient support layer comprises alternating foam portions and air cell portions. Further, in another embodiment the patient support layer comprises a first foam layer adjacent a head end of the mattress, a first air mattress portion adjacent the foot end of the mattress, a second air mattress portion adjacent the first foam layer, and a second foam layer adjacent the first air mattress portion.

According to yet another embodiment, the encasing comprises a removable cover having a cavity. Further, in a preferred embodiment the encasing comprises a lower encasing connected with a zipper to an upper encasing. In one embodiment, the upper encasing comprises a urethane coated spandex to allow the top cover to be breathable but substantially impervious to water.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
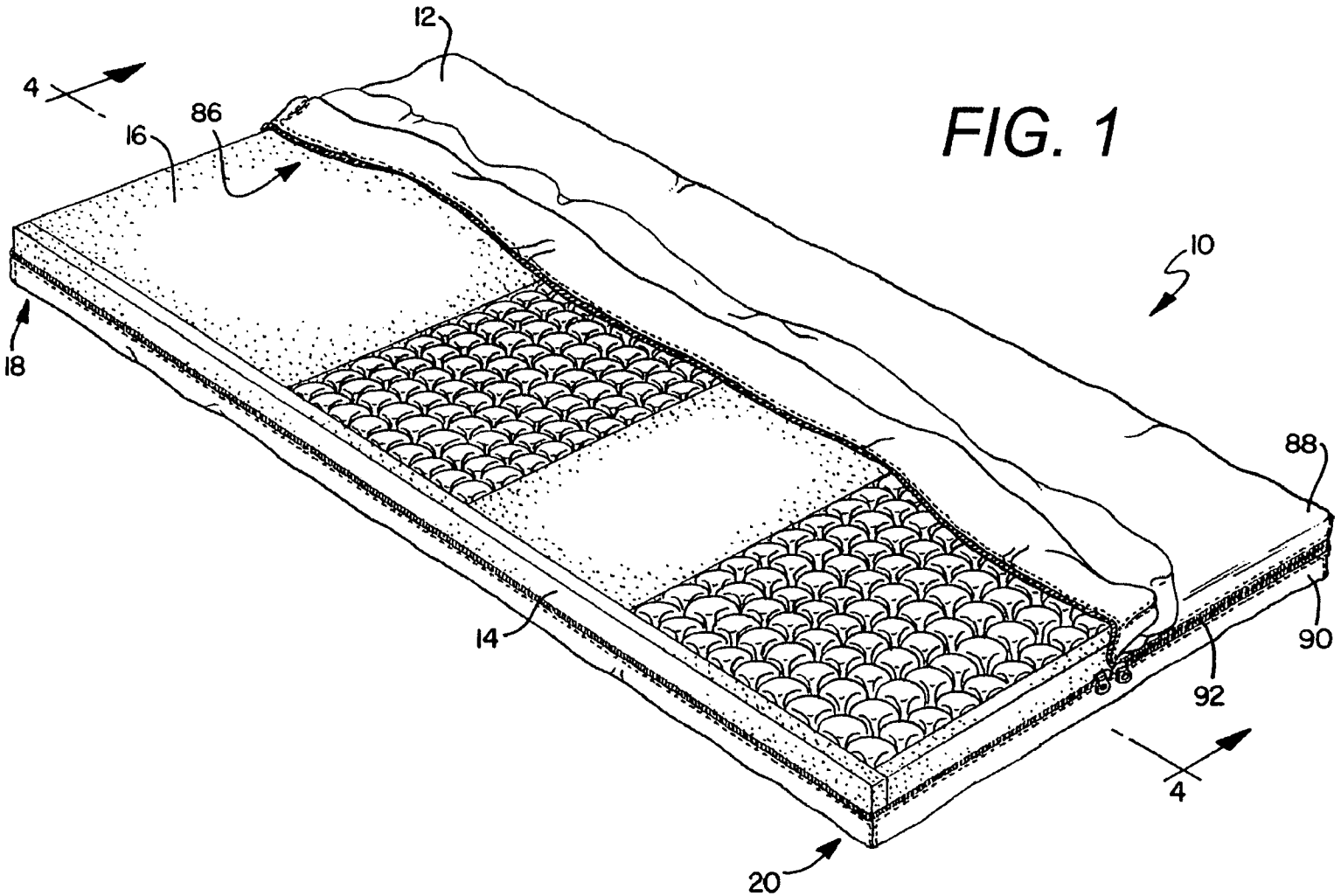
FIG. 1 is an assembled perspective view of one embodiment of a therapeutic mattress with the mattress cover partially open.
Figure 2:
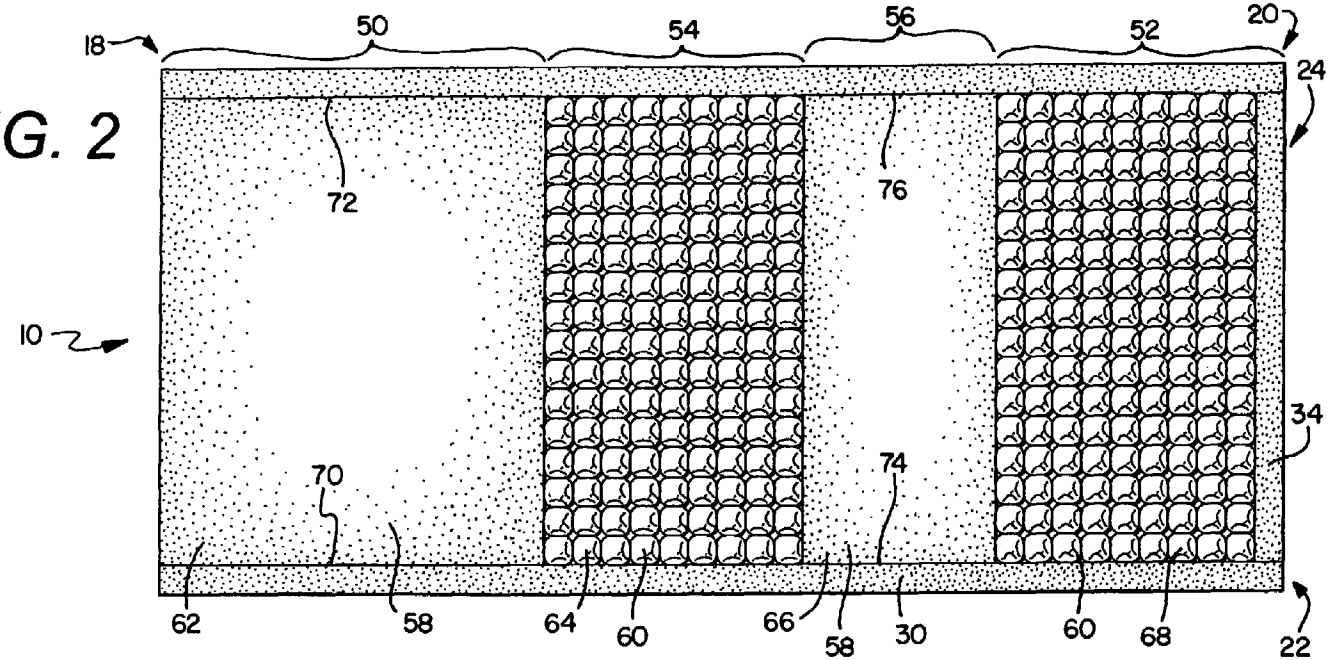
FIG. 2 is a top view of the therapeutic mattress of FIG. 1 with the mattress cover removed.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 5:
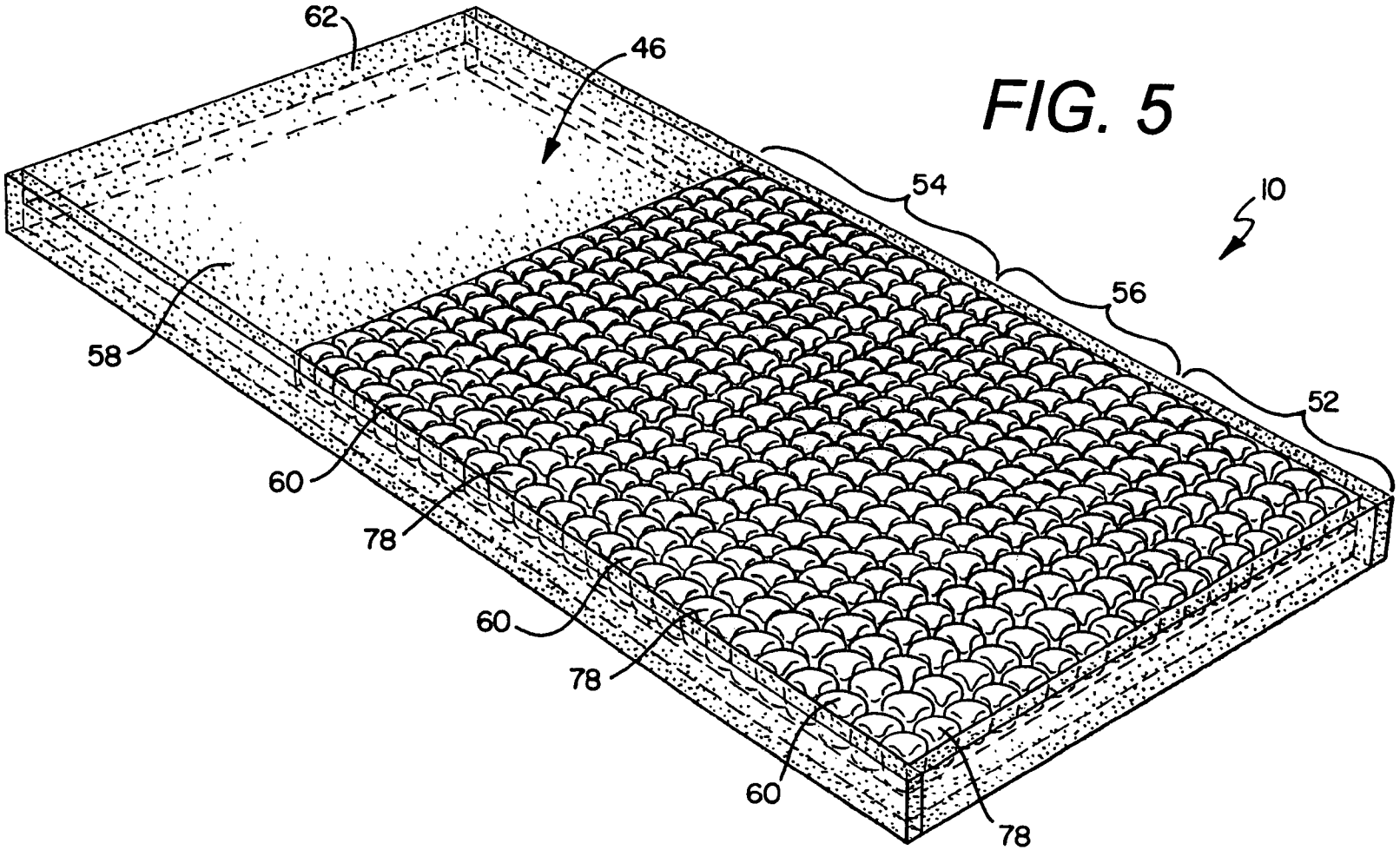
FIG. 5 is an assembled perspective view of another embodiment of a therapeutic mattress with the mattress cover partially open.

Referring now to the Figures, and specifically FIGS. 1 and 5, there are shown various embodiments of a therapeutic mattress 10. The therapeutic mattress 10 generally comprises a covering or encasing 12 housing a first or base layer 14 and a patient support layer 16. Often, patients confined to a bed for a long period of time frequently develop pressure sores, which can be known as decubitus ulcers or the more commonly referred to bedsores. The various embodiments of the therapeutic mattress 10 described herein assist in preventing or decreasing the potential for such bedsores for some patients, in conjunction with proper care and nutrition.

As shown in the Figures, the therapeutic mattress 10 has a head end 18 and a foot end 20 opposing the head end 18, a first side 22 and a second side 24 opposing the first side 24. The term "head end" is used to denote the end of any referred to object that is positioned to lie nearest the head end 18 of the mattress 10, and the term "foot end" is used to denote the end of any referred to object that is positioned to lie nearest the foot end 20 of the mattress 10. Generally, the therapeutic mattress 10 provides components for the various sections of the base layer 14 and patient support layer 16 of the mattress 10 that have varying levels of pressure relief and deflection as measured in units of either indentation load deflection (ILD) or pressure.

In one embodiment, the base layer 14 of the mattress 10 comprises a bottom member 28 and a perimetral frame. The perimetral frame provides support and shape to the mattress 10 and generally contains the patient support layer 16 within a defined boundary. In one embodiment, the perimetral frame comprises first and second opposing transverse side panels or members 30, 32, and a first end member 34. It is understood that in alternate embodiments, as discussed herein, a second end member opposing the first end member 34 may be provided to provide a perimetral frame that traverses about the entire perimeter of the mattress 10 interior of the encasing 12.

The bottom member 38 is preferably made of a high density, high resilient, low compression open cell urethane foam that is fire retardant and is set for medical bedding. In one embodiment the bottom member 28 is approximately 3" thick and has an ILD value of generally greater than 30, and preferably 40. The bottom member 28 in the embodiment shown extends generally from the head end 18 to the foot end 20 of the mattress 10, and generally from the first side 22 to the second side 24 of the mattress 10. In alternate embodiments the bottom member 38 may be much thinner, allowing for a thicker patient support layer 16. Additionally, it is understood that instead of being comprised of foam, one or more sections or portions of the bottom member 28 may be comprised of a gel, fluid or other pressure compensating media, generally referred to as a non-inflatable component. Further, the bottom member 28 may be comprised of one or more inflatable and/or non-inflatable components. The bottom member 28 may also be comprised of a foam having a plurality of independently projecting foam cells.

Figure 6A:
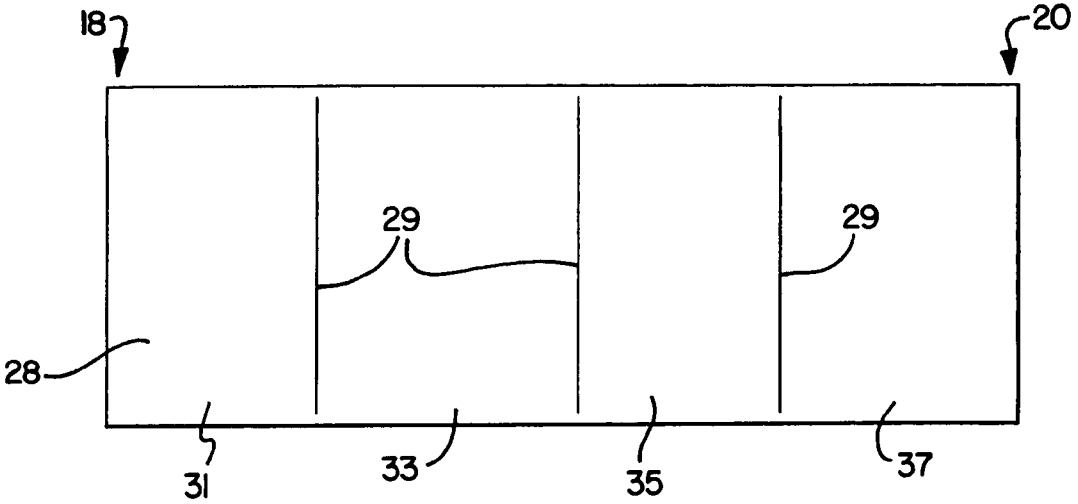
FIGS. 6A and 6B are different embodiments of a bottom member of the therapeutic mattress and, FIG. 7 is an assembled perspective view of another embodiment of a therapeutic mattress with all four patient support zones made of inflatable components.
Figure 6B:
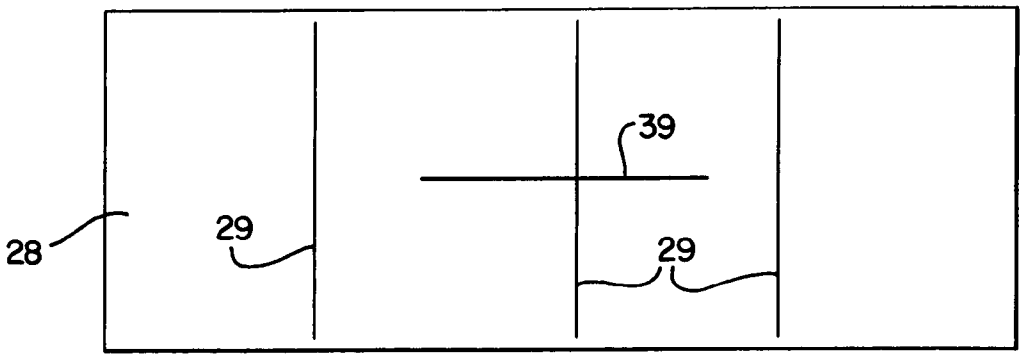
Figure 7:
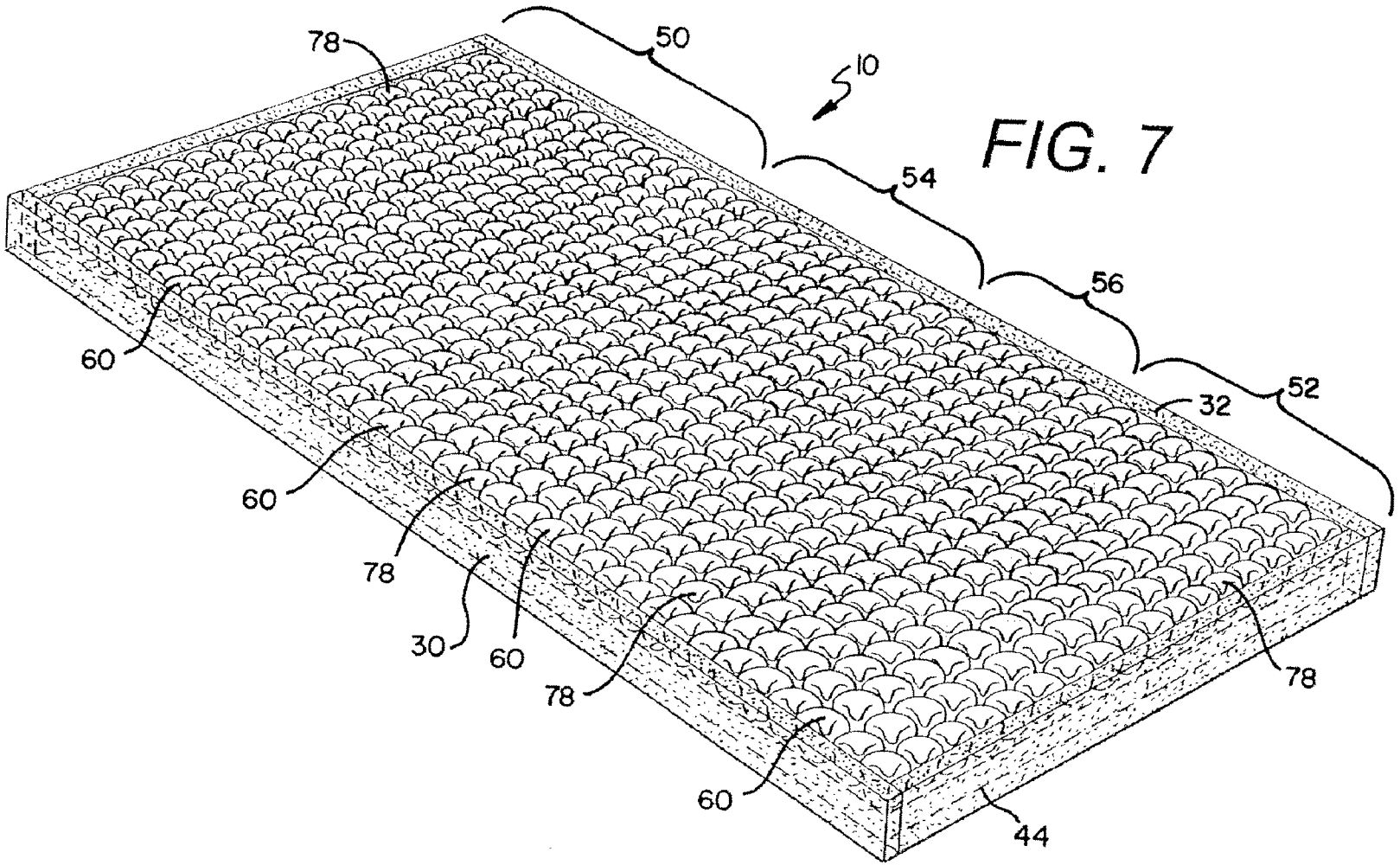

In various embodiments the bottom member 28 is a substantially flat and unitary member, as shown in FIGS. 1-5. Alternate embodiments of the bottom member 28 are shown in FIGS. 6A and 6B. In these embodiments, the bottom member 28 may have various regions at different portions thereof. As shown in FIG. 6A, multiple transverse openings 29 are provided through the bottom member 28 to create separate zones thereof to allow more independent movement of the mattress 10 in each zone. For example, openings 29 are provided in the bottom member 29 between the head zone 31 and the seat zone 33, between the seat zone 33 and the knee zone 35, and between the knee zone 35 and the foot zone 37 of the bottom member 28. More or fewer openings 29 may be provided in the bottom member 28 to accomplish the desired result. While the openings 29 shown in FIG. 6A do not intersect the perimeter of the bottom member 28, such that the bottom member 28 remains as a unitary element, it is understood that one or more of the openings 29 could intersect the perimeter of the bottom member 28 to separate portions thereof, such as shown in FIG. 6B. FIG. 6B also demonstrates that the bottom member 28 may have one or more longitudinal openings 39, including a longitudinal opening 39 that intersects a transverse opening 29. Further, independent portions of the patient support member 16 may be provided on each of the various regions of the bottom member 28 created by the openings 29, 39. It is understood that the side members 30, 32 would hold the bottom member 28 together.

Figure 4:
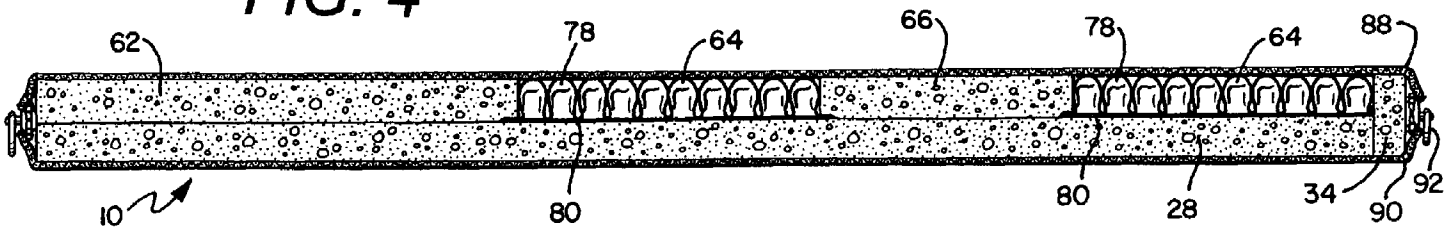
FIG. 4 is a side cross-sectional elevation view of the mattress through line 4-4 of FIG. 1.
Figure 3:
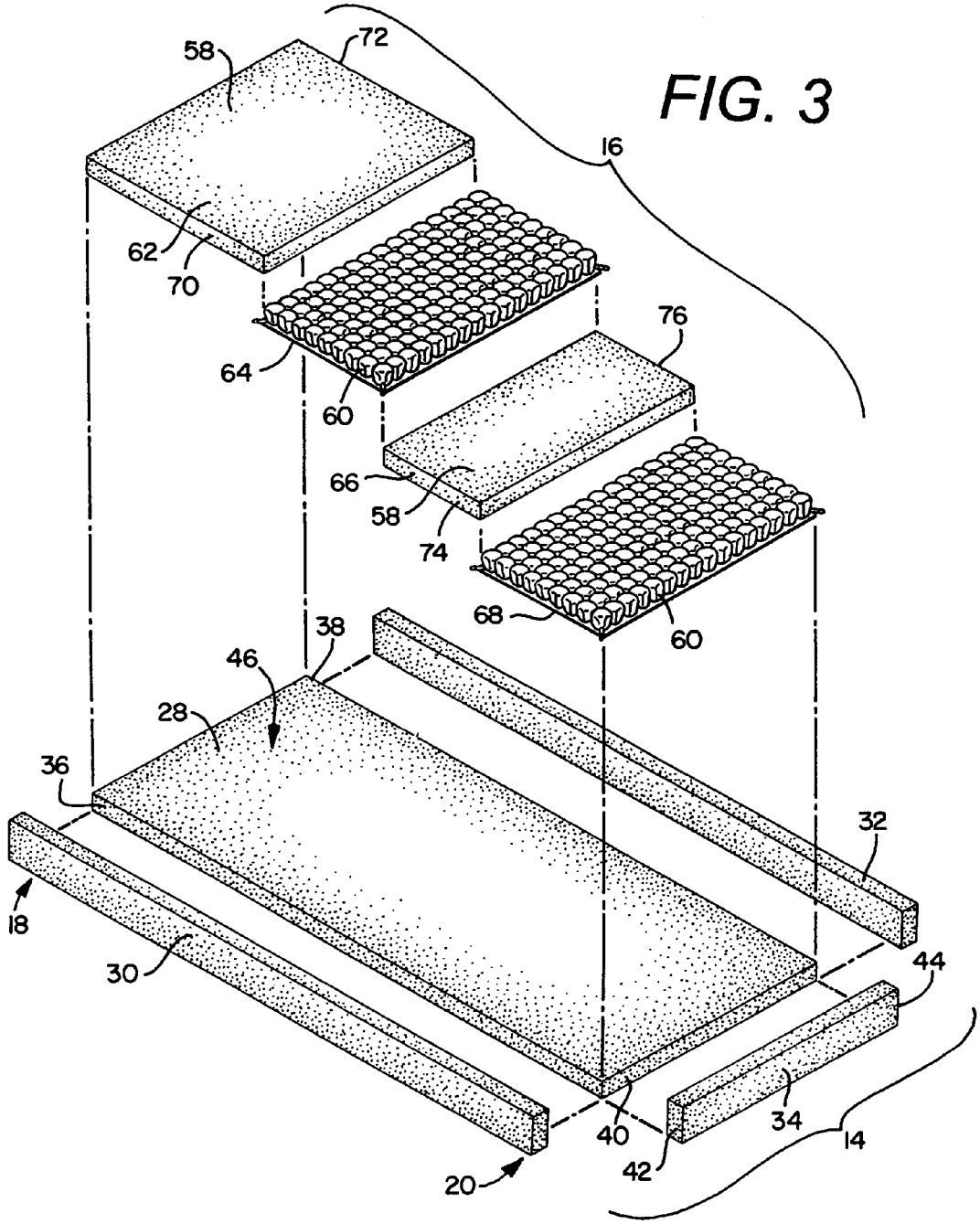
FIG. 3 is an exploded perspective of the therapeutic mattress of FIG. 1 with the mattress cover removed.

As shown in FIGS. 3 and 4, the opposing side members 30, 32 are also preferably made of a high density, high resilient, low compression open cell urethane foam that is fire retardant and is set for medical bedding. In one embodiment the side members 30, 32 are approximately 2" thick by 6.25" high, and they have an ILD value which is greater than the ILD value of the bottom member 18. In a preferred embodiment, the ILD value of the side members 30, 32 is generally greater than 40, and preferably 65.

In the embodiments shown, the side members 30, 32 extend approximately from the head end 18 of the mattress 10 to the foot end 20 of the mattress 10. The side members 30, 32 are connected to the side edges 36, 38 of the bottom member 28, preferably at the contact surfaces at each side 22, 24, respectively, thereof. As shown in FIG. 3, the first side member 30 is connected to the first side edge 36 of the bottom member 28 at the first side 22 of the bottom member 28, and the second side member 32 is connected to the second side edge 38 of the bottom member 28 at the second side 24 of the bottom member 28. Preferably, any conventional and commercially available adhesive which is compatible with urethane foam and suitable for medical applications may be utilized.

Similarly, the end member 34 is also preferably made of a high density, high resilient, low compression open cell urethane foam that is fire retardant and is set for medical bedding. In one embodiment, like the side members 30, 32, the end member 34 is approximately 2" thick by 6.25" high, and it has an ILD value which is greater than the ILD value of the bottom member 28. Additionally, in a preferred embodiment the ILD value of the end member 34 is substantially similar to the ILD value of the side members 30, 32, and in a most preferred embodiment the ILD value of the end member 34 is generally greater than 40, and preferably 65.

As shown in FIG. 3, the end member 34 is connected to an end edge 40 of the bottom member 28 at the foot end 20 thereof, and preferably at the contact surface at the foot end 20 thereof. Additionally, in the embodiments shown, the end members 34 extend approximately from the first side 22 of the mattress 10 to the second side 24 of the mattress 10. In such embodiments a first end 42 of the end member 34 is connected to an interior surface at the foot end 20 of the first side member 30, and a second end 44 of the end member 34 is connected to an interior surface at the foot end 20 of the second side member 32. Preferably, any conventional and commercially available adhesive which is compatible with urethane foam and suitable for medical applications may be utilized to secure the end member 34 to the foot end 20 of the bottom member 28 and the first and second side members 30, 32.

As explained above, a second end member may be provided at the head end 18 of the mattress 10. This second end member would typically be secured to the head end 18 of the bottom member 28, and the head end 18 of the first and second side members 30, 32, similar to the securement of the first end member 34 to the foot end 20 of the bottom member 28.

Because the side members 30, 32 and the end member 34 of the base are approximately 6.25" high and the bottom member 28 is approximately 3" high, a cavity or well 46 that is approximately 3.25" deep is defined between the bottom member 28 and the opposing side members 30, 32 and end member 34. Alternate embodiments employing different thicknesses of the bottom member 28 and different thicknesses of the components making up the perimetral frame will have different depths of the well or cavity 46. This cavity 46 is preferably utilized to house the patient support layer 16 as explained and shown herein.

Referring to FIGS. 3 and 5, the patient support layer 16 is positioned above the base layer 14, and the patient support layer 16 generally comprises a plurality of zones or sections to support different portions of a patient's body. For example, in the embodiments of FIGS. 3 and 5, the patient support layer 16 comprises a head zone 50 adjacent a head end 18 of the mattress 10, a foot zone 52 adjacent the foot end 20 of the mattress 10, a seat zone 54 adjacent the head zone 50 at the foot end thereof, and a knee zone 56 adjacent the head end of the foot zone 52 at one end and adjacent the seat zone 54 at the other end thereof. It is understood, however, that a fewer number or greater number of zones of the patient support layer 16 may be utilized with the present mattress 10, including zones which do not extend from one side of the mattress to the other side of the mattress, such as can be utilized with the bottom member 28 as shown in FIG. 6B hereof. Further, the size of each zone may vary.

In preferred embodiments, various zones or sections of the patient support layer 16 are made of a non-inflatable component 58, and different zones or sections of the patient support layer 16 are made of an inflatable or air mattress component 60. For example, in the embodiment of FIGS. 2 and 3, the portion of the patient support layer 16 in the head zone 50 is made of a non-inflatable foam material component 62, the portion of the patient support layer 16 in the seat zone 54 is made of inflatable component 64, the portion of the patient support layer 16 in the knee zone 56 is made of a non-inflatable foam material component 66, and the portion of the patient support layer 16 in the foot zone 52 is made of an inflatable component 68. Alternately, the different zones or sections of the patient support layer 16 may be made entirely of inflatable components 60 or entirely of non-inflatable components. In generally any embodiment of the patient support layer 16, however, including the embodiment of the patient support layer 16 having inflatable components 60 thereto, the patient support layer 16 is provided on the base layer 14. Instead of foam, however, the non-inflatable components 58 of the patient support layer 16 may be comprised of a gel, liquid fluid or some other non-inflatable pressure compensating media.

While different non-inflatable materials may be utilized without departing from the scope of the present invention, in one embodiment the first foam component 62 utilized in the head zone 50 adjacent the head end 18 of the mattress 10 is a urethane memory-type foam that is fire retardant and is set for medical bedding. Further, in a preferred embodiment, the foam component 62 for the head zone 50 has a density of between 2.0 and 6.0 lbs, and preferably at least 2.5 lbs but generally not greater than 5.0 lbs. Alternately, the foam component 62 for the head zone 50 may be referred to as having an ILD value of between 15 and 40 ILD. Additionally, the foam component 62 for the head zone 50 has a first side 70 adjacent the first side member 30, and a second side 72 adjacent the second side member 32. Moreover, in one embodiment the foam component 62 in the head zone 50 is approximately 3.25" thick to fill the cavity or well 46 of the base layer 14, which in one embodiment is approximately 3.25" deep as explained above. Preferably, the ILD value of the foam component 62 for the head zone 50 is less than the ILD value of both the bottom member 28 and the side members 30, 32 of the base member 14. In one embodiment the foam component 62 for the head zone 50 is fixed, typically with an adhesive as explained above, to the base layer 14.

Similarly, in one embodiment the second foam component 66 utilized in the knee zone 56 is a urethane memory-type foam that is fire retardant and is set for medical bedding. Further, in a preferred embodiment, the foam component 66 for the knee zone 56 has a density of between 2.0 and 6.0 lbs, and preferably at least 2.5 lbs but not greater than 5.0 lbs. Alternately, the foam component 66 for the knee zone 56 may be referred to as having an ILD value of between 15 and 40 ILD. As shown in FIG. 3, this foam component 66 for the knee zone 56 has a first side 74 adjacent the first side member 30, and a second side 76 adjacent the second side member 32. The foam component 66 in the knee zone 56 is also approximately 3.25" thick to fill the cavity or well 46 of the base layer 14. Finally, in a preferred embodiment the ILD value of the foam component 66 for the knee zone 56 is less than the ILD value of both the bottom member 28 and the side members 30, 32 of the base member 14, and is typically the same as the foam component 62 for the head zone 50. Further, the foam components for the patient support layer 16 are typically less rigid than the foam components of the base layer 14. This foam component 66 may be secured to either the base layer 14 or to the other components of the patient support layer 16.

In one embodiment, a first inflatable air mattress component 68 is utilized in the foot zone 52, and a second inflatable air mattress component 64 is utilized in the seat zone 54. Alternately, additionally inflatable components 60 may also be utilized in the head zone 50 and knee zone 56. In a preferred embodiment, as shown in the figures, the inflatable components generally comprise a plurality of low-pressure, soft, fluidly interconnected but independently movable, air-filled cells 78 which are able to redistribute air pressure between each of the cells 78 in the inflatable component to conform to the contours of a patient's body with minimal tissue deformation to provide a friction and shear relief surface. Such inflatable components are typically non-powered, meaning they are in a closed system. The air cells 78 are generally arranged in an array of rows and columns which are fluidly connected across a flexible base 80 on the inflatable components 60. In one embodiment, the air cells 78 have a substantially rectangular body that is approximately 3.5" high, with a top wall that has a generally pyramidal or conical shape thereto. Further, the air cells 78 have a generally square cross-sectional shape. Generally, like the foam mattress portions 58 of the patient support member 16, the air mattress components 60 are provided in the cavity or well 46 of the base layer 14, and extend from the first side member 30 to the second side member 32 of the base layer 14. In one embodiment, as disclosed in FIG. 1, the inflatable component 60 is positioned such that the flexible base 80 is provided adjacent the bottom member of the base layer 14, and the air cells 78 project upwardly toward the upper encasing member 88. In alternate embodiments, multiple components of the inflatable component 60 may be stacked on one another at various zones of the mattress 10. For example, in one zone a first or lower inflatable component 60 may be provided on the bottom member 28 of the base layer 14, and a second or upper inflatable component 60 may be provided on the first inflatable component. Further, the lower inflatable component may be orientated such that its inflatable components are positioned adjacent the bottom member 28 of the base layer 14 and its flexible base 80 is raised off the bottom member 28. Then, the upper inflatable component is layered on the lower inflatable component by placing the base layer 14 of the upper inflatable component on the base layer 14 of the lower inflatable component, and having the inflatable components of the upper inflatable component project upwardly and away from the lower inflatable component. One of ordinary skill in the art would readily understand that additional combinations and orientations of the inflatable components may be utilized, such as having both the upper and lower inflatable components orientated similarly, without departing from the scope or the spirit of the present invention.

The air cells 78 can be adjusted to the patient's body shape and size. In a preferred embodiment, the inflatable components 60 are provided in a closed system, meaning they are non-powered and require no external power source once they are inflated to the appropriate pressure. Thus, after the inflatable components 60 are inflated, they are maintained at that pressure, however, should any leakage or seepage occur they may be re-inflated to the desired pressure. In a preferred embodiment, the inflatable components 60 are made of a durable neoprene rubber that is flame-resistant and can be easily cleaned. Each of the inflatable components 60 of the different zones can be removed and replaced, if necessary. Further, the inflatable components 60 can be connected to adjacent members, including foam members, typically by snapping together, connecting with Velcro, or by some other acceptable means.

In the embodiment shown in FIGS. 1-4, the patient support layer 16 comprises alternating foam components 58 with inflatable components 60. Specifically, foam components 58 are provided in the head zone 50 and knee zone 56, and inflatable components 60 are provided in the seat zone 54 and foot zone 52. Generally, inflatable components 60 are utilized to support areas of the patient's body which are most susceptible to bed sores, such as the hips/buttocks and the heels. Accordingly, inflatable components 60 having air cells 78 are provided in these zones 52, 54. Conversely, in the embodiment shown in FIG. 5, the patient support layer 16 comprises a single foam component 58 in the head zone 50, with inflatable components 60 in each of the seat zone 54, knee zone 56 and foot zone 52. Such an embodiment may be utilized with patients that need additional pressure relief in the knee zone 56, or for patients in which the first embodiment described above is not satisfactory.

Referring now to FIGS. 1 and 4, the entire base member 14 and patient support member 16 are housed in a cavity 86 of the removable encasing 12. Typically the encasing 12 comprises a top or upper encasing member 88 and a bottom or lower encasing member 90. The top encasing member 88 is connected to the bottom encasing member 90 with a connector 92, such as a zipper 92, generally positioned about the midline of the side walls 30, 32 of the mattress 10. In a preferred embodiment, the top encasing member 88 is made of a breathable (i.e., air permeable) stretch material that is coated with a material, such as urethane, to make it substantially impervious to water. Additionally, the material of the top encasing member 88 should be stretchy, so as not to provide unacceptable shear for the patient. In a preferred embodiment the material of the top encasing member 88 is made of a polyurethane coated nylon/spandex material. In a preferred embodiment, the stretch material is made of a 80% nylon and 20% spandex blend, such as LYCRA. The bottom encasing member 90, however, is generally made of 200 denier double-sided nylon coated urethane. Opposing parts of the zipper 92 are connected to the appropriate top and bottom encasing members 88, 90.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A therapeutic mattress for supporting a body of a user in a prone position, comprising:

a base member having first and second opposing longitudinal foam sidewalls extending upwardly from the base member to define a well, the longitudinal foam sidewalls extending in a direction substantially parallel to a longitudinal axis of the therapeutic mattress; and, a patient support member positioned in the well, the patient support member having a non-air cushion portion and an air cushion portion adjacent the non-air cushion portion, wherein the non-air cushion portion and the air cushion portion extend from approximately the first sidewall to the second sidewall, and wherein the air cushion portion comprises a first individually-zoned air cushion member and a second individually-zoned air cushion member, each air cushion member having a plurality of rows and columns of vertically extending, fluidly interconnected and self-equalizing air cells, the air cells being connected to a base of the air cushion member and extending vertically upward and generally perpendicular to the base of the air cushion member, the air cells further being independently moveable in a plurality of directions.

2. The therapeutic mattress of claim 1, wherein the base member comprises a foam base member.

3. The therapeutic mattress of claim 1, wherein the base member is connected to the sidewalls.

4. The therapeutic mattress of claim 1, wherein the sidewalls have a height that extends from a bottom of the base member.

5. A therapeutic mattress for supporting an entire body of a user in a prone position, comprising:

a base member and first and second generally firm upstanding longitudinally extending foam side walls connected at opposing sides of the base member to define a well; and, a patient support layer within the well, the patient support layer having a plurality of separately zoned sections, including a head zone adjacent a head end of the mattress, a foot zone adjacent a foot end of the mattress, and a seat zone between the head zone and the foot zone, wherein the patient support layer in the head zone comprises a first separate and independent non-powered air cell section extending generally from the first sidewall to the second sidewall, wherein the patient support layer in the seat zone comprises a second separate and independent non-powered air cell section extending generally from the first sidewall to the second sidewall, and wherein the patient support layer in the foot zone comprises a third separate and independent non-powered air cell section, wherein the air cell sections in each of the head, seat and foot zones are separate from the longitudinally extending side walls such that the air cell sections are free from connection to the longitudinally extending side walls to allow members of the air cell sections in each of the head zone, foot zone and seat zone to move independently from the longitudinal extending sidewalls, wherein each air cell section has a bottom wall adjacent the base member, wherein the therapeutic mattress has an overall footprint and wherein the patient support layer in each zone has a footprint that is approximately one-quarter of the overall surface area of the therapeutic mattress, wherein each air cell section is independently inflatable and deflatable with respect to the air cell sections in other zones of the mattress to independently set and adjust an air pressure of each air cell section, and wherein each air cell section comprises a plurality of individual air cell members fluidly interconnected to be self-equalizing, each of the air cell members having a sidewall extending vertically from a bottom of the air cell member and terminating in a top wall of each air cell member, each air cell having a height extending from the bottom of the air cell member to the top wall of the air cell member, and each air cell member of the air cell sections also being independently moveable in a plurality of directions, including the x, y and z directions.

* * * * *